US007596341B2

(12) United States Patent
Yokoi

(10) Patent No.: US 7,596,341 B2
(45) Date of Patent: Sep. 29, 2009

(54) IMAGE FORMING APPARATUS WITH VERTICALLY ARRANGED PROCESS UNITS

(75) Inventor: Katsuyuki Yokoi, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/714,153

(22) Filed: Mar. 6, 2007

(65) Prior Publication Data

US 2007/0154238 A1 Jul. 5, 2007

Related U.S. Application Data

(63) Continuation of application No. 11/256,103, filed on Oct. 24, 2005, now Pat. No. 7,203,448, which is a continuation of application No. 10/801,797, filed on Mar. 17, 2004, now Pat. No. 6,973,279.

(30) Foreign Application Priority Data

Mar. 20, 2003 (JP) ..... 2003-078102

(51) Int. Cl.
*G03G 15/00* (2006.01)

(52) U.S. Cl. ..... 399/124

(58) Field of Classification Search ..... 399/124, 399/107, 113, 114, 298, 299
See application file for complete search history.

(56) References Cited

U.S. PATENT DOCUMENTS 5,122,841 A * 6/1992 Sasaki ..... 399/124
5,162,846 A 11/1992 Cahill
5,787,324 A 7/1998 Iwasaki
5,802,426 A 9/1998 Miyazaki et al.
5,839,032 A * 11/1998 Yasui et al. ..... 399/124
5,974,290 A * 10/1999 Inoue ..... 399/124
5,987,291 A * 11/1999 Masuda ..... 399/302
5,991,570 A 11/1999 Haga et al.
6,134,404 A 10/2000 Iwai et al.
6,215,970 B1 4/2001 Yoshikawa et al.
6,453,135 B1 9/2002 Sameshima et al.
6,600,885 B2 7/2003 Kida
6,763,211 B2 7/2004 Yokoyama
6,801,742 B1 * 10/2004 Mochimaru et al. ..... 399/309
6,968,142 B2 11/2005 Armitsu et al.

(Continued)

FOREIGN PATENT DOCUMENTS

JP A 1-92135 4/1989

(Continued)

*Primary Examiner*—Quana M Grainger
(74) *Attorney, Agent, or Firm*—Oliff & Berridge, PLC

(57) ABSTRACT

An image forming apparatus, includes: a mainframe having an opening portion; an electrostatic latent image carrier being loadable in and unloadable from the mainframe through the opening portion; a transport path; a first opening and closing member provided openably and closably on the mainframe so as to open and close the opening portion; and a second opening and closing member disposed on a side opposite to the electrostatic latent image carrier with respect to the first opening and closing member and provided openably and closably on the mainframe so as to open and close the transport path. The first opening and closing member and the second opening and closing member are openable and closable integrally with each other. The second opening and closing member is openable and closable independently of the first opening and closing member.

24 Claims, 8 Drawing Sheets

U.S. PATENT DOCUMENTS

| | | | | |
|---|---|---|---|---|
| 6,973,279 | B2 | 12/2005 | Yokoi | |
| 7,113,199 | B2 * | 9/2006 | Hattori et al. | 347/115 |
| 7,130,560 | B2 * | 10/2006 | Kawai et al. | 399/110 |
| 7,162,182 | B2 * | 1/2007 | Tonges et al. | 399/110 |
| 7,269,379 | B2 * | 9/2007 | Nakanishi | 399/122 |
| 2002/0041775 | A1 | 4/2002 | Ishii | |
| 2003/0108359 | A1 * | 6/2003 | Chung | 399/124 |
| 2003/0185601 | A1 * | 10/2003 | Toyohara et al. | 399/298 |
| 2003/0235430 | A1 | 12/2003 | Koshida | |
| 2004/0109709 | A1 * | 6/2004 | Ishibashi et al. | 399/303 |
| 2005/0163533 | A1 | 7/2005 | Hashimoto et al. | |

FOREIGN PATENT DOCUMENTS

| | | |
|---|---|---|
| JP | A 6-3873 | 1/1994 |
| JP | A 8-220818 | 8/1996 |
| JP | A 9-141972 | 6/1997 |
| JP | A 10-307439 | 11/1998 |
| JP | A 2000-321843 | 11/2000 |
| JP | A 2003-84556 | 3/2003 |

* cited by examiner

IMAGE FORMING APPARATUS WITH VERTICALLY ARRANGED PROCESS UNITS

This is a Continuation of application Ser. No. 11/256,103 filed Oct. 24, 2005, now U.S. Pat. No. 7,203,448 which is a Continuation of application Ser. No. 10/801,797 filed Mar. 17, 2004, now issued as U.S. Pat. No. 6,973,279 which are hereby incorporated by reference in its entirety. This application claims priority to Japanese Patent Application No. 2003-078102 filed Mar. 20, 2003, which is hereby incorporated by reference in its entirety.

BACKGROUND OF THE INVENTION

1. Field of the Invention

The present invention relates to an image forming apparatus such as a printer which forms a color image by means of superimposition of toner images respectively formed on plural electrostatic latent image carriers.

2. Background Art

As a color image forming apparatus such as a printer or a facsimile apparatus, known is a tandem image forming apparatus in which process units each including: a photosensitive member serving as an electrostatic latent image carrier; a charging device and an exposing device that form an electrostatic latent image on the photosensitive member; and a developing device that develops the electrostatic latent image formed on the photosensitive member by a toner are disposed respectively for colors (for example, four colors of cyan, magenta, yellow, and black), and the color toner images respectively formed on the photosensitive members are transferred so as to be superimposed on one another, thereby forming a color image.

In some of such tandem image forming apparatuses, plural process units are horizontally arranged (for example, see JP-A-10-307439 (Page 4)).

However, such a so-called lateral tandem image forming apparatus has a problem in that the installation area is large. Therefore, a so-called vertical tandem system in which plural process units are vertically arranged so as to reduce the installation area has been proposed.

SUMMARY OF THE INVENTION

Such a vertical tandem image forming apparatus may be contemplated to have a configuration in which a recording medium (for example, a paper sheet) is transported by a transporting section along plural process units that are vertically arranged, and toner images are transferred to the recording medium by a transferring section during the vertical transportation.

In the thus configured vertical tandem image forming apparatus, the transport path for a recording medium is long, and hence a jam easily occurs. When a jam once occurred, the transporting section is opened so that the jammed recording medium can be removed away. In this configuration, when a photosensitive member is to be replaced with another one, however, the photosensitive member cannot be taken out unless the transporting section is opened and the transferring section is then opened, thereby causing a problem in that the work of replacing the photosensitive member is cumbersome. During the work of replacing the photosensitive member, the transporting section must be once opened. When the worker accidentally touches the transporting section, fingermarks are formed on the transporting section, and there arises the possibility that a printing failure may occur. When the transporting section is stained by a toner or the like, the clothes or the hands may be soiled.

An image forming apparatus is disclosed herein, in which works of removing a jammed sheet and replacing an electrostatic latent image carrier can be easily conducted.

According to one aspect of the invention, an image forming apparatus, including: a mainframe having an opening portion; an electrostatic latent image carrier on which an electrostatic latent image formed to be developed with a developer, the electrostatic latent image carrier being loadable in and unloadable from the mainframe through the opening portion; a transport path through which a recording medium is transported to be formed image thereon; a first opening and closing member provided openably and closably on the mainframe so as to open and close the opening portion; and a second opening and closing member disposed on a side opposite to the electrostatic latent image carrier with respect to the first opening and closing member and provided openably and closably on the mainframe so as to open and close the transport path. The first opening and closing member and the second opening and closing member are openable and closable integrally with each other. The second opening and closing member is openable and closable independently of the first opening and closing member.

According to another aspect of the invention, the electrostatic latent image carrier includes a plurality of electrostatic latent image that are disposed respectively for colors and vertically arranged.

In the thus configured image forming apparatus, the second opening and closing member can be opened without opening the first opening and closing member, and in addition the first and second opening and closing members can be integrally opened.

When a recording medium is jammed in the transport path, therefore, the second opening and closing member can be opened without opening the first opening and closing member, and the recording medium can be then removed away. When the electrostatic latent image carriers are to be attached or detached, moreover, the first and second opening and closing members can be integrally opened from the same side as that in the case of removal of a jammed recording medium, so that the opening portion can be opened. Therefore, the opening portion can be easily opened in order to attach or detach the electrostatic latent image carriers.

According to another aspect of the invention, an image forming apparatus, includes: a mainframe having an opening portion; an electrostatic latent image carrier loadable in and unloadable from the mainframe through the opening portion; a first opening and closing member provided rotatably on the mainframe and disposed exterior to the electrostatic latent image carrier so as to open and close the opening portion; a transport path through which a recording medium is transported the transport path disposed exterior to the first opening and closing member; a second opening and closing member provided rotatably on the mainframe and disposed exterior to the transport path so as to cover and uncover the transport path; and a coupling member that couples the first opening and closing member with the second opening and closing member so that the first opening and closing member and the second opening and closing member are rotatable integrally.

BRIEF DESCRIPTION OF THE DRAWINGS

The present invention may be more readily described with reference to the accompanying drawings.

DETAILED DESCRIPTION OF THE PREFERRED EMBODIMENTS

Embodiment 1

Hereinafter, Embodiment 1 of the invention will be described with reference to the accompanying drawings.

Figure 1:
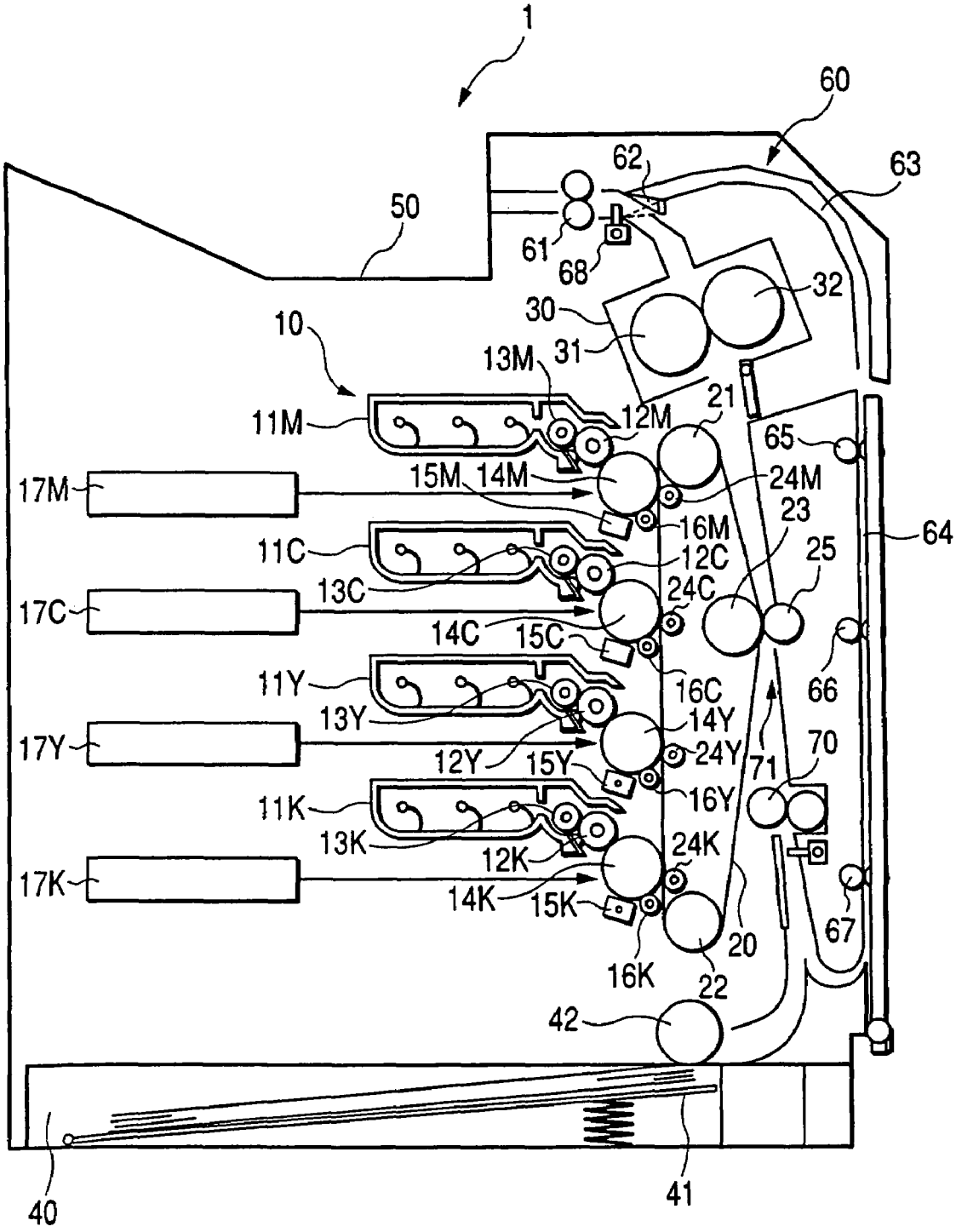
FIG. 1 is a schematic side section view of a color laser printer of Embodiment 1.

FIG. 1 is a schematic side section view of a color laser printer 1 that is an image forming apparatus to which the invention is applied. The color laser printer 1 which is exemplarily shown in FIG. 1 comprises an image forming unit 10, a belt-like intermediate transfer member 20, a fixing unit 30, a sheet feeding unit 40, a sheet discharging tray 50, and an inverting and transporting unit 60.

For steps of forming visual images by respective toners serving as developers of magenta (M), cyan (C), yellow (Y), and black (K), the image forming unit 10 comprises: developing devices 11M, 11C, 11Y, 11K; photosensitive drums 14M, 14C, 14Y, 14K; cleaning rollers 16M, 16C, 16Y, 16K; charging devices 15M, 15C, 15Y, 15K; and exposing devices 17M, 17C, 17Y, 17K.

The developing device, the photosensitive drum, the cleaning roller, and the charging device for each of the colors are integrated to one another to constitute a process unit. Each process unit is attachable to and detachable from the color laser printer 1.

Hereinafter, each of the components will be described in detail.

The developing devices 11M, 11C, 11Y, 11K comprise developing rollers 12M, 12C, 12Y, 12K, respectively. Each of. the developing rollers 12M, 12C, 12Y, 12K uses electrically conductive silicone rubber as a base material, and is formed into a columnar shape. A coating layer made of a material containing fluorine such as a resin or a rubber material is formed on the surface of the roller.

The developing devices 11M, 11C, 11Y, 11K comprise supply rollers 13M, 13C, 13Y, 13K, respectively. The supply rollers 13M, 13C, 13Y, 13K are electrically conductive sponge rollers, and placed so as to be in press contact with the developing rollers 12M, 12C, 12Y, 12K by the elasticities of the sponges, respectively.

A toner container which accommodates a positively chargeable polymer toner is formed in each of the developing devices.

For example, a drum in which a positively chargeable photosensitive layer is formed on a base member made of aluminum is used as each of the photosensitive drums 14M, 14C, 14Y, 14K.

The cleaning rollers 16M, 16C, 16Y, 16K are rollers each formed by an elastic member such as electrically conductive sponge, and placed below the photosensitive drums 14M, 14C, 14Y, 14K so as to be in sliding contact with the photosensitive drums 14M, 14C, 14Y, 14K, respectively. A voltage the polarity of which is opposite to that of a toner or is negative is applied by a power source (not shown) to the cleaning rollers 16M, 16C, 16Y, 16K so that residual toners on the photosensitive drums 14M, 14C, 14Y, 14K are removed away by the functions of sliding frictional forces and the electric fields due to the voltages on the photosensitive drums 14M, 14C, 14Y, 14K. In the embodiment, a so-called cleaner-less developing system is employed. When, in a predetermined cycle after a developing step, a voltage which causes removed residual toners to return to the respective photosensitive drums is once applied to the cleaning rollers 16M, 16C, 16Y, 16K, therefore, the removed residual toners are returned toward the photosensitive drums 14M, 14C, 14Y, 14K, respectively.

The charging devices 15M, 15C, 15Y, 15K are scorotron charging devices, and placed below the photosensitive drums 14M, 14C, 14Y, 14K and downstream of the cleaning rollers 16M, 16C, 16Y, 16K in the rotation direction of the photosensitive drums 14M, 14C, 14Y, 14K, so as to be opposed to the surfaces of the photosensitive drums 14M, 14C, 14Y, 14K, respectively. Alternatively, roller charging devices which are in contact with the photosensitive drums 14M, 14C, 14Y, 14K may be used as the charging devices 15M, 15C, 15Y, 15K.

The exposing devices 17M, 17C, 17Y, 17K are configured by well-known laser scanner units, and expose the surfaces of the photosensitive drums 14M, 14C, 14Y, 14K to laser beams at positions downstream of the charging devices 15M, 15C, 15Y, 15K in the rotation direction of the photosensitive drums 14M, 14C, 14Y, 14K, respectively. The surfaces of the photosensitive drums 14M, 14C, 14Y, 14K are illuminated with laser beams corresponding to image data by the exposing devices 17M, 17C, 17Y, 17K, and electrostatic latent images for the colors are formed in the surfaces of the photosensitive drums 14M, 14C, 14Y, 14K, respectively.

In the above configuration, at portions where the developing rollers 12M, 12C, 12Y, 12K are in contact with the photosensitive drums 14M, 14C, 14Y, 14K, the electrostatic latent images having the plus polarity (positively charged) can be developed with the positively charged toners by the reversal developing method, so that images of a very high quality can be formed.

The belt-like intermediate transfer member 20 is configured by forming an electrically conductive sheet of polycarbonate, polyimide, or the like into a belt-like shape. As shown in FIG. 1, the belt-like intermediate transfer member 20 is looped around one driving roller 21 and two driven rollers 22, 23. Intermediate transfer rollers 24M, 24C, 24Y, 24K are disposed in the vicinities of positions where the intermediate transfer member is opposed to the photosensitive drums 14M, 14C, 14Y, 14K, respectively. As shown in FIG. 1, the surface of the intermediate transfer member 20 on the side opposed to the photosensitive drums 14M, 14C, 14Y, 14K is set so as to be moved from the vertically upper side to the lower side.

When a predetermined voltage is applied by a power source (not shown) to the intermediate transfer rollers 24M, 24C, 24Y, 24K, the toner images formed on the photosensitive drums 14M, 14C, 14Y, 14K are transferred to the intermediate transfer member 20. A secondary transfer roller 25 is opposed to the driven roller 23 which is placed at a position where the toner images are to be transferred to a sheet P (corresponding to a recording medium). When a predetermined potential is applied by a power source (not shown) to the secondary transfer roller 25, the toner images of the four colors carried on the belt-like intermediate transfer member 20 are transferred to the sheet P which is transported between the secondary transfer roller 25 and the intermediate transfer member 20.

The fixing unit 30 is configured by a first heating roller 31 and a second heating roller 32. The sheet P to which the four-color toner images have been transferred is heated and pressed by the first and second heating rollers 31 and 32 while being clamped and transported, thereby the toner images are fixed to the sheet P.

The sheet feeding unit 40 is disposed in the lowermost portion of the apparatus, and configured by: a storage tray 41 which accommodates plural sheets P in a stacked manner; and a pick-up roller 42 which separates the stacked sheets P and feeds the sheets one by one. The sheet feeding unit 40 feeds the sheet P in predetermined timing with the image forming step which is conducted by the image forming unit 10 and the intermediate transfer member 20. The sheet P fed from the sheet feeding unit 40 is transported by a transport roller pair 70 to a transferring position in a sheet transport path 71, or specifically to a pressure contact portion between the intermediate transfer member 20 and the secondary transfer roller 25.

The sheet transport path 71 is a path along which the sheet P fed from the storage tray 41 of the sheet feeding unit 40 is sent to the fixing unit 30 through the transport roller pair 70 and the pressure contact portion between the intermediate transfer member 20 and the secondary transfer roller 25.

The sheet P which has passed through the fixing unit 30 is transported by a discharge roller pair 61 toward the sheet discharging tray 50.

The sheet discharging tray 50 is disposed in the uppermost portion of the apparatus, and accommodates the sheet P which is transported by the discharge roller pair 61 to be discharged.

The inverting and transporting unit 60 is configured by the discharge roller pair 61, a flapper 62, an inversion and transport path 63, an inversion and transport path 64, and inverting and transporting roller pairs 65, 66, 67. The discharge roller pair 61 can be switched over between forward and reverse rotations. When the sheet P is to be discharged to the sheet discharging tray 50, the roller pairs are forward rotated, and, when the sheet P is to be transported to the inversion and transport path 63, the roller pairs are reversely rotated.

The flapper 62 is disposed in a portion branching in the direction along which the sheet P is to be discharged to the sheet discharging tray 50, and that along which the sheet is to be transported to the inversion and transport path 63. Depending on excitation and non-excitation of a switching solenoid which is not shown, the flapper can be swung between a position where the sheet P is discharged to the sheet discharging tray 50 (the position indicated by the solid line in FIG. 1), and that where the sheet is transported to the inversion and transport path 63 (the position indicated by the broken line in FIG. 1).

The inverting and transporting roller pairs 65, 66, 67 are disposed in the inversion and transport path 64 so that the sheet P transported from the inversion and transport path 63 to the inversion and transport path 64 is transported from the vertically upper side to the lower side to again transport the sheet to the transport roller pair 70.

Next, the operation of the thus configured color laser printer 1 of the embodiment will be described. First, the surfaces of the photosensitive drums 14M, 14C, 14Y, 14K are uniformly charged by the charging devices 15M, 15C, 15Y, 15K, and then exposed by the exposing devices 17M, 17C, 17Y, 17K in accordance with magenta, cyan, yellow, and black images, respectively. The magenta, cyan, yellow, and black developing devices 11M, 11C, 11Y, 11K causes magenta, cyan, yellow, and black toners to adhere to electrostatic latent images formed in the surfaces of the photosensitive drums 14M, 14C, 14Y, 14K, thereby developing magenta, cyan, yellow, and black images. The magenta, cyan, yellow, and black toner images which are formed as described above are once transferred onto the surface of the intermediate transfer member 20.

After the transfer process, residual toners on the photosensitive drums 14M, 14C, 14Y, 14K are temporarily held by the cleaning rollers 16M, 16C, 16Y, 16K. The toner images of the colors are formed with producing a small time difference therebetween in accordance with the movement speed of the intermediate transfer member 20 and the positions of the photosensitive drums 14M, 14C, 14Y, 14K, and then transferred so as to overlap with one another on the intermediate transfer member 20.

The four-color toner images which are formed on the intermediate transfer member 20 as described above are transferred to the sheet P fed from the sheet feeding unit 40, at the pressure contact portion between the secondary transfer roller 25 and the intermediate transfer member 20. The transferred toner images are fixed to the sheet P by the fixing unit 30, and the sheet is then discharged onto the sheet discharging tray 50. As a result, a four-color image is formed.

In the case where images are to be formed respectively on both the faces of the sheet P, the printer operates in the following manner. When the sheet P in which an image has been formed on one face is sent to the discharge roller pair 61, the discharge roller pair 61 is forward rotated while clamping the sheet P, to once transport the sheet P toward the outside (the sheet discharging tray 50). Immediately after a major portion of the sheet P is sent to the outside and the rear end of the sheet P is detected by a discharge sensor 68, the forward rotation is stopped, and the transportation direction is switched over by the flapper 62 so that the sheet P can be transported to the inversion and transport path 63.

Then, the discharge roller pair 61 is reversely rotated to transport the sheet P into the inversion and transport path 63. The sheet P which is transported to the inversion and transport path 63 is further transported to the transport roller pair 70 by the inverting and transporting roller pairs 65, 66, 67.

The sheet P which is transported to the transport roller pair 70 is in the reversed state, and again transported by the transport roller pair 70 toward the pressure contact portion between the secondary transfer roller 25 and the intermediate transfer member 20. Toner images are then transferred to the back face, and then fixed thereto. As a result, images are formed respectively on both the faces of the sheet P.

Figure 2:
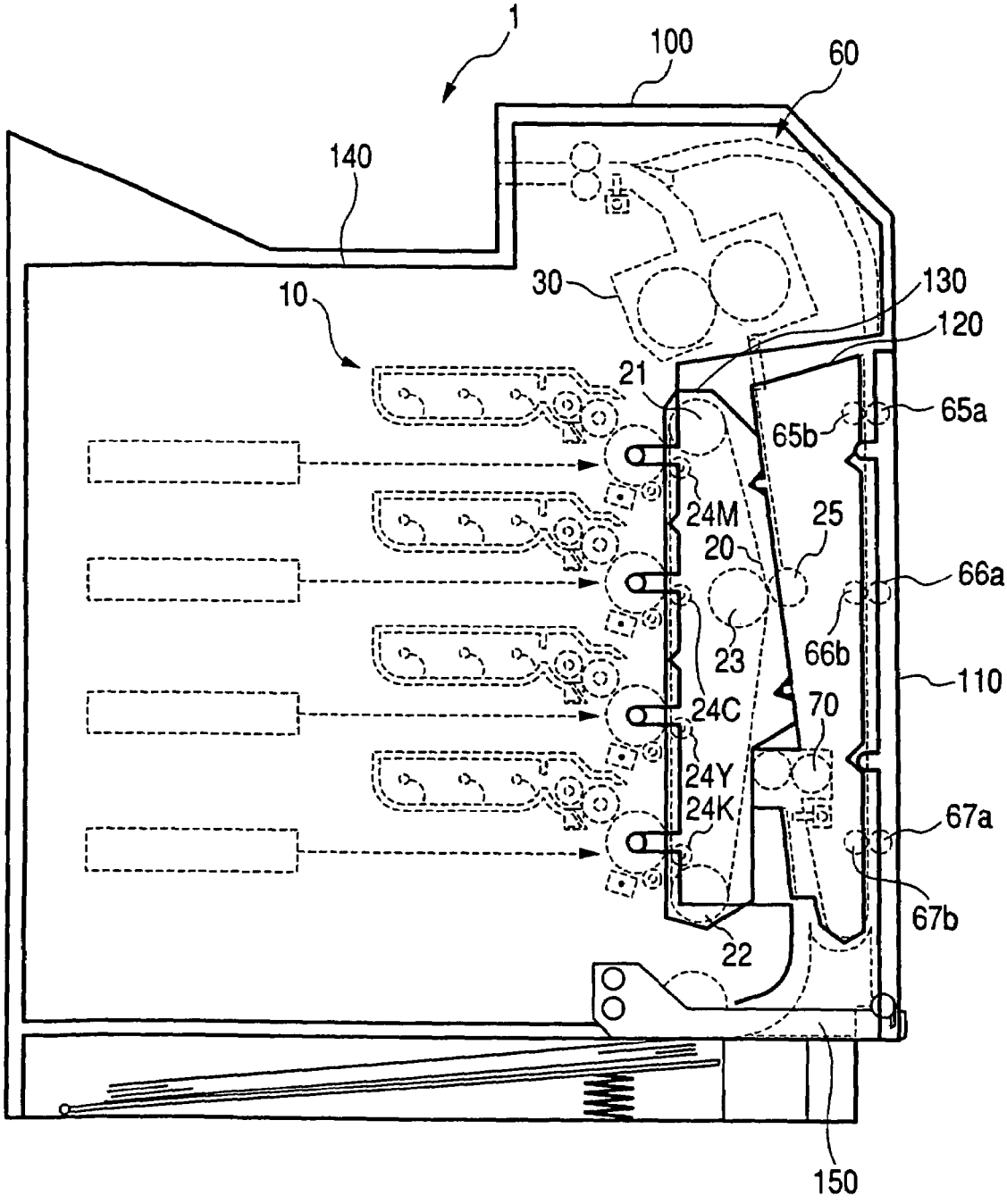
FIG. 2 is a schematic view of the color laser printer of Embodiment 1.
Figure 3:
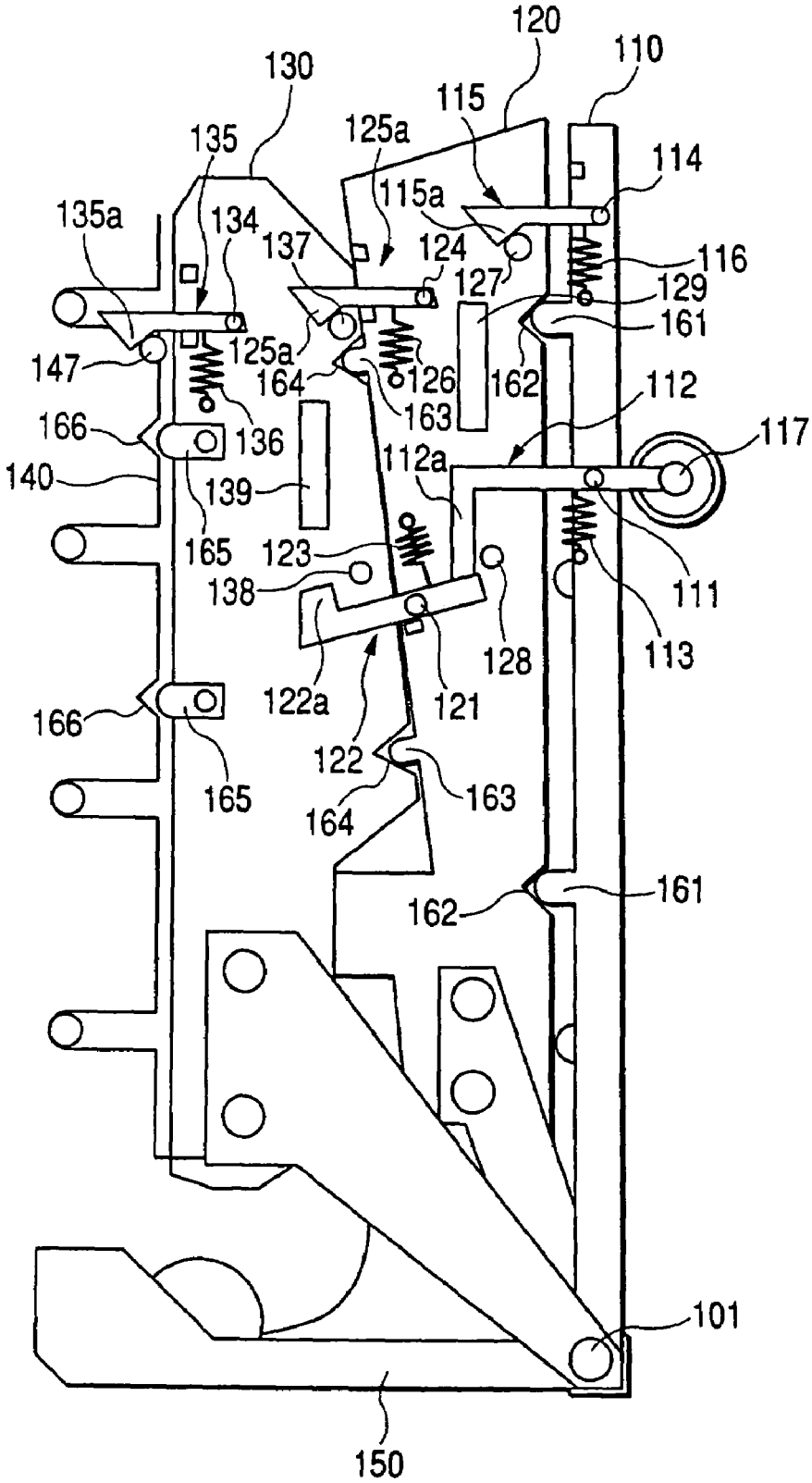
FIG. 3 is a diagram of an opening and closing mechanism of the color laser printer of Embodiment 1.

Next, an opening and closing mechanism of the color laser printer 1 for opening and closing an opening portion 190 (see FIG. 6) through which the process units are to be attached and detached., and the sheet transport path 71 or the inversion and transport path 64 will be described. FIG. 2 is a schematic view of the color laser painter 1, and FIG. 3 is a view showing the configuration of an opening and closing mechanism.

As shown in FIG. 2, a front cover 110, a frame 120, a frame 130, and a frame 140 are disposed in a main unit casing 100 of the color laser printer 1. The inversion and transport path 64 is formed between the front cover 110 and the frame 120, and the sheet transport path 71 is formed between the frame 120 and the frame 130. When the frame 130 is opened, the opening portion 190 (see FIG. 6) for allowing the process units to be attached or detached is opened.

Driven rollers 65*a*, 66*a*, 67*a* of the inverting and transporting roller pairs are supported by the front cover 110. Driving rollers 65*b*, 66*b*, 67*b* of the inverting and transporting roller pairs, the transport roller pair 70, and the secondary transfer roller 25 are supported by the frame 120.

The intermediate transfer member 20, the intermediate transfer rollers 24M, 24C, 24Y, 24K, the driving roller 21, and the driven rollers 22 and 23. are supported by the frame 130. The image forming unit 10, the fixing unit 30, and a part of the inverting and transporting unit 60 are supported by the frame 140.

The front cover 110, the frame 120, and the frame 130 are swingable about a rotation shaft 101, so as to be supported openably and closably by a support frame 150 which is secured to the frame 140 (see FIG. 3). Support shafts 111 are disposed on both the side faces of the front cover 110, respectively (in FIG. 3, only one side face is shown). Lock levers 112 are supported so as to be swingable about the support shafts 111. At one end, the lock levers 112 have hook portions 112*a* which are engageable and disengageable with projections 128 disposed on the side faces of the frame 120, respectively. The lock levers are urged by springs 113 attached to the front cover 110, in the direction along which the hook portions 112*a* are to be engaged with the projections 128, respectively. A handle 117 is attached to the other ends of the lock levers 112 so as to connect the other ends together.

In a state where the hook portions 112*a* are caused by the springs 113 to be engaged with the projections 128, the tip ends of the hook portions 112*a* are engaged with the projections 128, and, when the handle 117 is operated, the lock levers 112 can be moved in the urging direction of the springs 113.

Support shafts 121 are disposed on both the side faces of the frame 120, and lock levers 122 are supported so as to be swingable about the support shafts 121, respectively. At one end, the lock levers 122 have hook portions 122*a* which are engageable and disengageable with projections 138 disposed on the side faces of the frame 130, respectively. The lock levers are urged by springs 123 attached to the frame 120, in the direction along which the hook portions 122*a* are not engaged with the projections 138, respectively. The other ends of the lock levers 122 are opposed to the hook portions 112*a* of the lock levers 112.

Support shafts 114 are disposed on both the side faces of the front cover 110, and engaging levers 115 are supported so as to be swingable about the support shafts 114, respectively. At one end, the engaging levers 115 have engaging pawls 115*a* which are engageable and disengageable with projections 127 disposed on the side faces of the frame 120, respectively. The engaging levers are urged by springs 116 attached to the front cover 110, in the direction along which the engaging pawls 115*a* are to be engaged with the projections 127, respectively.

A positioning projection 161 which protrudes toward the frame 120 is disposed at each of two or upper and lower positions of the both sides of the front cover 110. The positioning projections 161 can be fitted into grooves 162 disposed in front faces of the both sides of the frame 120, respectively. When the projections are fitted into the grooves, the position in the case where the front cover 110 is closed is determined.

Support shafts 124 are disposed on both the side faces of the frame 120, and engaging levers 125 are supported so as to be swingable about the support shafts 124, respectively. At one end, the engaging levers 125 have engaging pawls 125*a* which are engageable and disengageable with projections 137 disposed on the side faces of the frame 130, respectively. The engaging levers are urged by springs 126 attached to the frame 120, in the direction along which the engaging pawls 125*a* are to be engaged with the projections 137, respectively.

A positioning projection 163 which protrudes toward the frame 130 is disposed at each of two or upper and lower positions of the both sides of the frame 120. The positioning projections 163 can be fitted into grooves 164 disposed in front faces of the both sides of the frame 130, respectively. When the projections are fitted into the grooves, the position in the case where the frame 120 is closed is determined.

Support shafts 134 are disposed on both the side faces of the frame 130, and engaging levers 135 are supported so as to be swingable about the support shafts 134, respectively. At one end, the engaging levers 135 have engaging pawls 135*a* which are engageable and disengageable with projections 147 disposed on the side faces of the frame 140, respectively. The engaging levers are urged by springs 136 attached to the frame 130, in the direction along which the engaging pawls 135*a* are to be engaged with the projections 147, respectively.

A positioning projection 165 which protrudes toward the frame 140 is disposed at each of two or upper and lower positions of the both sides of the frame 130. The positioning projections 165 can be fitted into grooves 166 disposed in front faces of the both sides of the frame 140, respectively. When the projections are fitted into the grooves, the position in the case where the frame 130 is closed is determined.

The urging forces of the springs 116, 126, 136 become larger in this sequence.

Next, an operation in the case where only the front cover 110 is to be opened will be described with reference to FIG. 4.

When the front cover 110, the frame 120, and the frame 130 are in the closed state, the hook portions 112*a* of the lock levers 112 are engaged with the projections 128, the hook portions 122*a* of the lock levers 122 are not engaged with the projections 138, the engaging pawls 115*a* of the engaging levers 115 are engaged with the projections 127, the engaging pawls 125*a* of the engaging levers 125 are engaged with the projections 137, and the engaging pawls 135*a* of the engaging levers 135 are engaged with the projections 147.

Figure 4B:
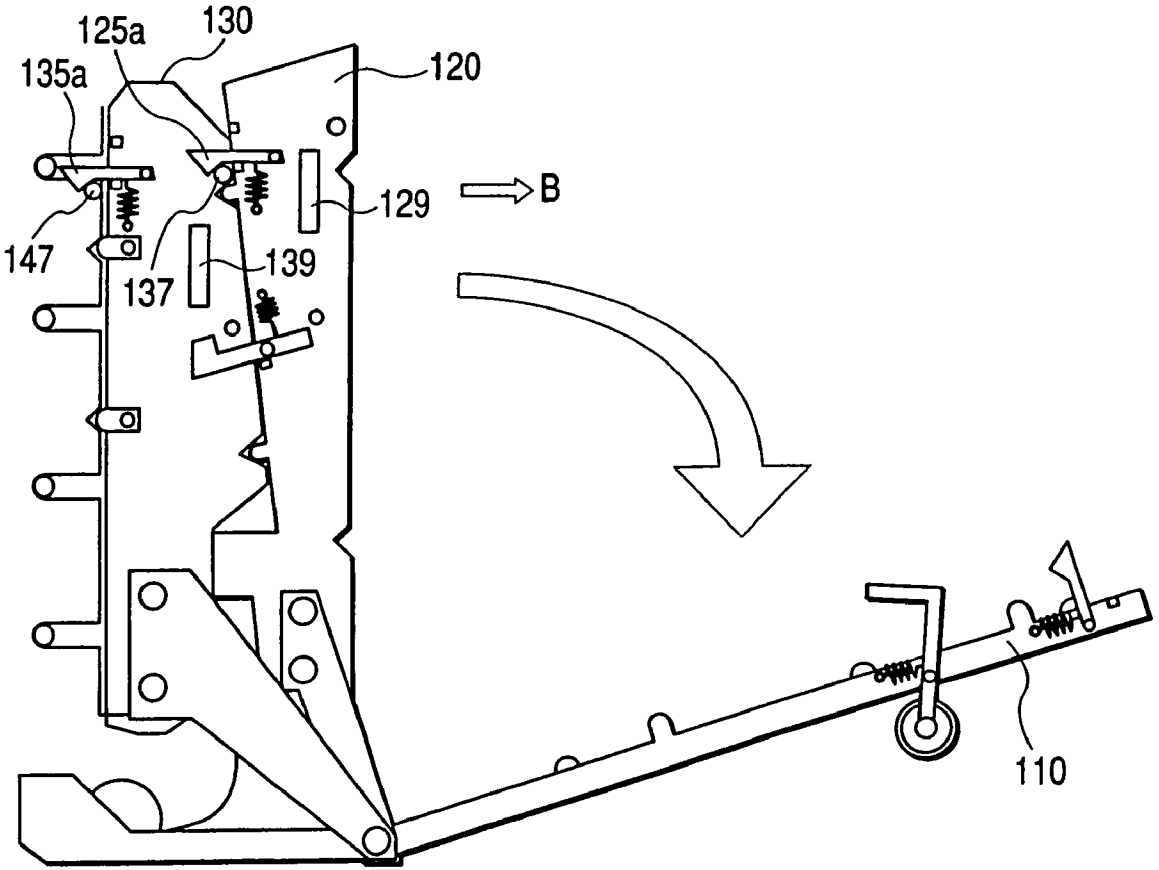
FIGS. 4A and 4B are diagrams of an opened state of the color laser printer of Embodiment 1.
Figure 4A:
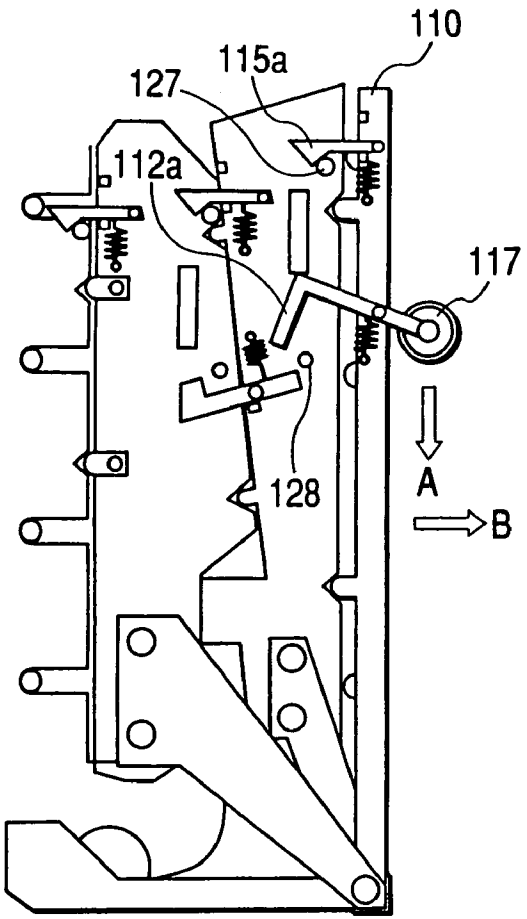

As shown in FIG. 4A, the handle 117 is swung against the urging force of the springs 113 in the direction A, specifically in a downward direction, and the engagement between the hook portions 112*a* and the projections 128 is then canceled. When the handle 117 is thereafter pulled in the direction B, specifically in a forward direction, the engagement between the engaging pawls 115*a* and the projections 127 is canceled because the urging forces of the springs 116 are smaller than those of the springs 126 and 136 and the engaging pawls 115*a* elongate at an obtuse angle with respect to the direction along which the front cover 110 is to be opened (the direction which is substantially identical with the direction B in the projections 127) and butt against the projections 127 to be engaged therewith. As shown in FIG. 4B, therefore only the front cover 110 is opened, and the inversion and transport path 64 is opened.

When, in the state shown in FIG. 4B, a handle 129 disposed on a side face of the frame 120 is pulled in the direction B, the engagement between the engaging pawls 125*a* and the projections 137 is canceled because the hook portions 122*a* of the lock levers 122 are not engaged with the projections 138, the urging forces of the springs 126 are smaller than those of the springs 136, and the engaging pawls 125*a* elongate at an obtuse angle with respect to the direction along which the frame 120 is to be opened (the direction which is substantially identical with the direction B in the projections 137) and butt against the projections 137 to be engaged therewith. Therefore, the frame 120 is opened, and the sheet transport path 71 is opened. When, in the state where the frame 120 is opened, a handle 139 disposed on a side face of the frame 130 is pulled in the direction B, the engagement between the engaging pawls 135*a* and the projections 147 is canceled because the engaging pawls 135*a* elongate at an obtuse angle with respect to the direction along which the frame 130 is to be opened (the direction which is substantially identical with the direction B in the projections 147) and butt against the projections 147 to be engaged therewith. Therefore, the frame 130 is opened, and the opening portion 190 for enabling the process units to be attached and detached is opened.

When, in the state shown in FIG. 4B, the handle 139 of the frame 130 is pulled in the direction B, the frame 120 and the frame 130 are integrally opened because the engaging pawls 125*a* of the engaging levers 125 are engaged with the projections 137. As a result, the opening portion 190 is opened.

Next, an operation in the case where the front cover 110 and the frame 120 are to be integrally opened without opening the frame 130 will be described with reference to FIG. 5.

Figure 5B:
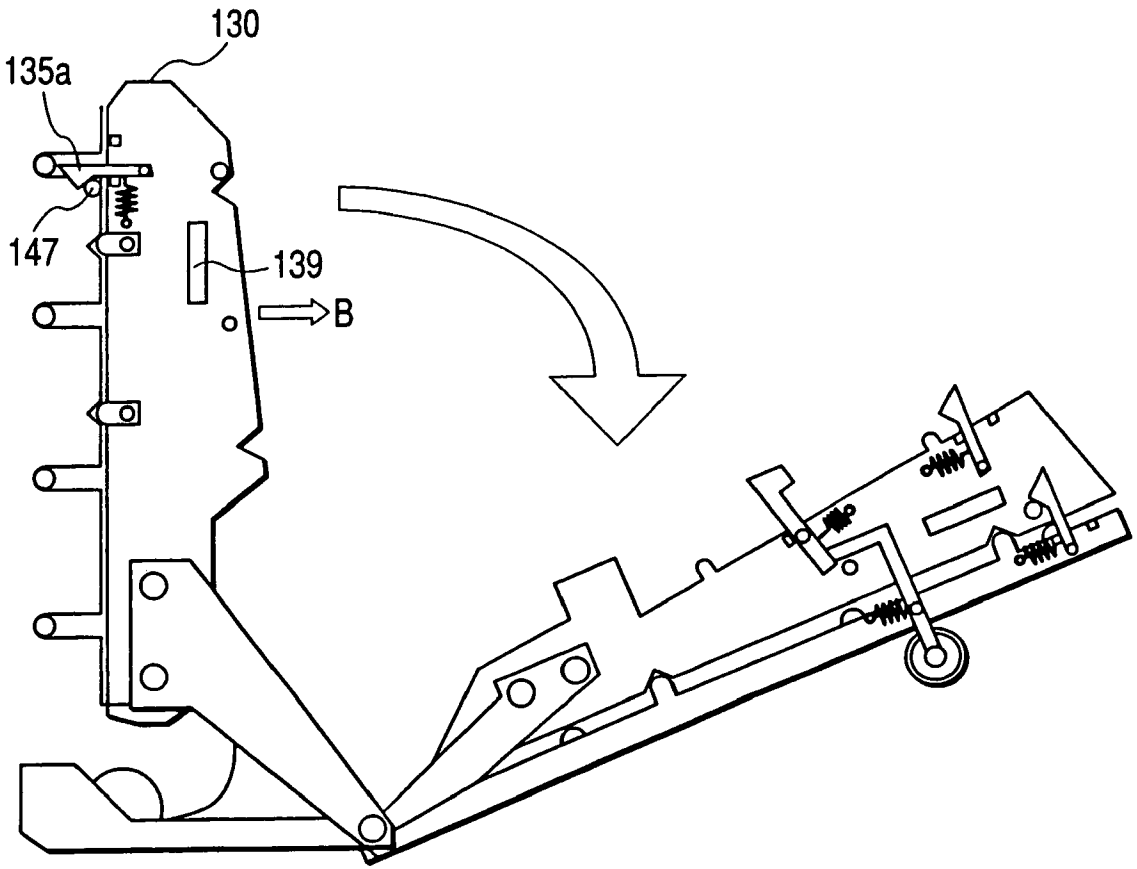
FIGS. 5A and 5B are diagrams of the opened state of the color laser printer of Embodiment 1.
Figure 5A:
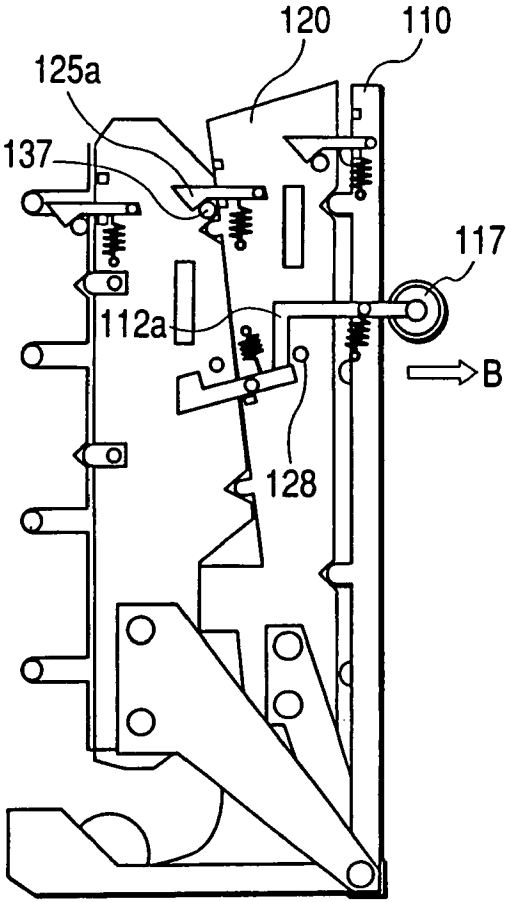

As shown in FIG. 5A, when, in the state where the front cover 110, the frame 120, and the frame 130 are closed, the handle 117 is pulled in the direction B, the engagement between the hook portions 112*a* and the projections 128 is not canceled, and the front cover 110 is integrated with the frame 120 because the hook portions 112*a* elongate at a right angle with respect to the direction along which the front cover 110 is to be opened (the direction which is substantially identical with the direction B in the projections 128) and butt against the projections 128 to be engaged therewith, and the engagement between the engaging pawls 125*a* and the projections 137 is canceled because the urging forces of the springs 126 are smaller than those of the springs 136 and the engaging pawls 125*a* elongate at an obtuse angle with respect to the direction along which the frame 120 is to be opened (the direction which is substantially identical with the direction B in the projections 137) and butt against the projections 137 to be engaged therewith. As shown in FIG. 5B, therefore, the front cover 110 and the frame 120 are integrally opened, and the sheet transport path 71 is opened.

When, in the state shown in FIG. 5B, the handle 139 of the frame 130 is pulled in the direction B, the engagement between the engaging pawls 135*a* and the projections 147 is canceled because the engaging pawls 135*a* elongate at an obtuse angle with respect to the direction along which the frame 130 is to be opened (the direction which is substantially identical with the direction B in the projections 147) and butt against the projections 147 to be engaged therewith. As a result, the frame 130 is opened, and the opening portion 190 for enabling the process units to be attached and detached is opened.

Next, an operation in the case where the front cover 110, the frame 120, and the frame 130 are to be integrally opened will be described with reference to FIG. 6.

Figure 6B:
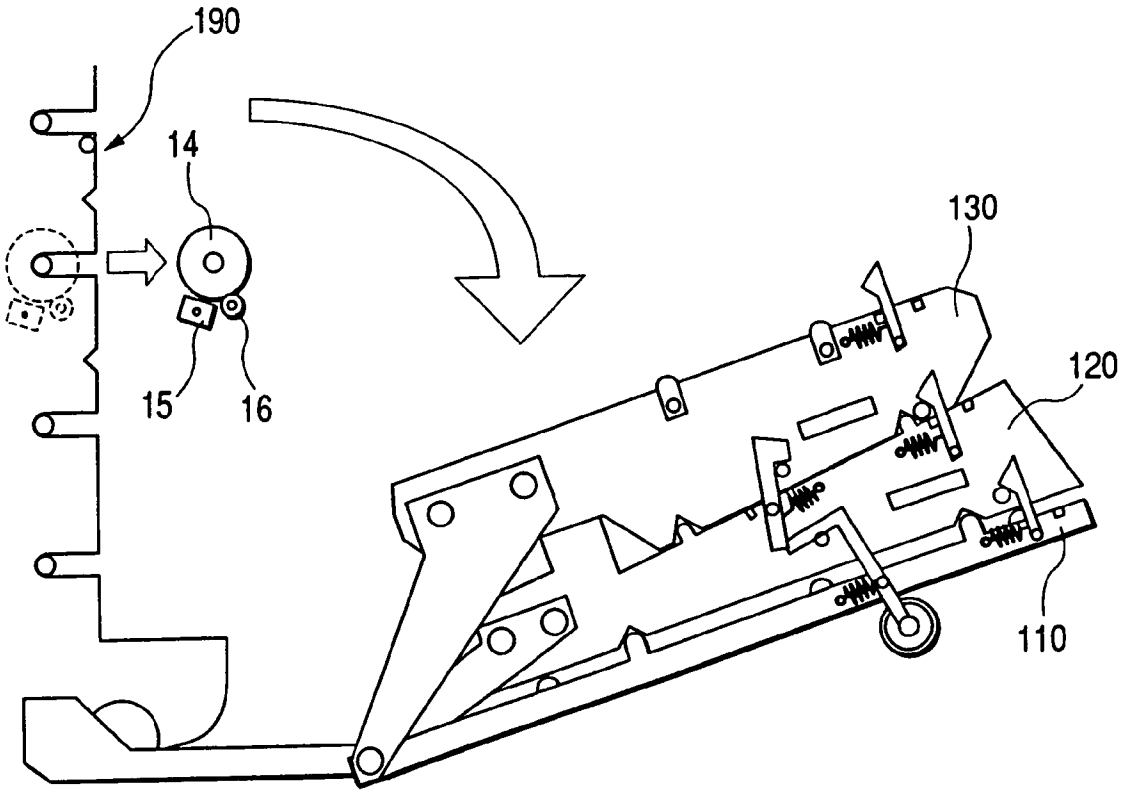
FIGS. 6A and 6B are diagrams of the opened state of the color laser printer of Embodiment 1.
Figure 6A:
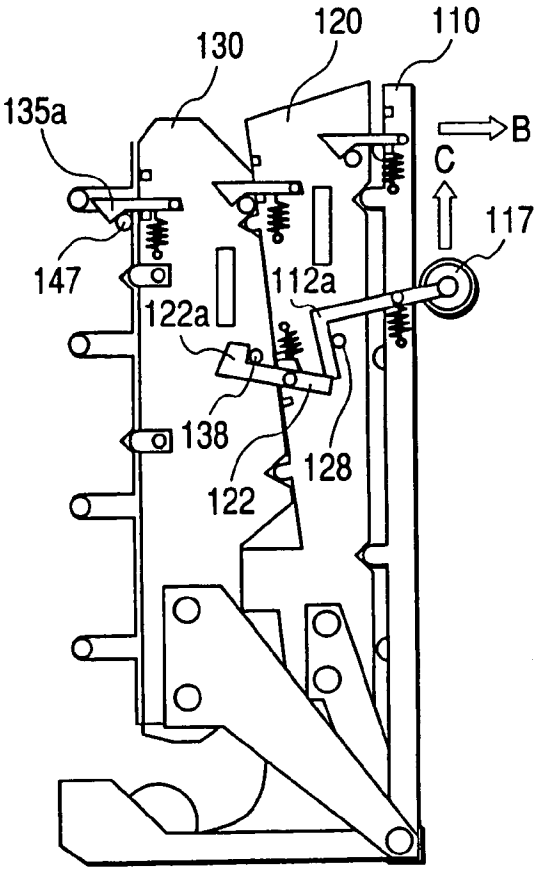

As shown in FIG. 6A, when, in the state where the front cover 110, the frame 120, and the frame 130 are closed, the handle 117 is swung in the direction C, specifically in an upward direction, the hook portions 112*a* downward push the other ends of the lock levers 122 while the engagement between the hook portions 122*a* and the projections 128 is maintained. Therefore, the lock levers 122 are swung to cause the hook portions 122*a* to be engaged with the projections 138. When the handle 117 is thereafter pulled in the direction B, the hook portions 112*a* of the lock levers 112 are engaged with the projections 128 because the hook portions 112*a* elongate at a right angle with respect to the direction along which the front cover 110 is to be opened (the direction which is substantially identical with the direction B in the projections 128) and butt against the projections 128 to be engaged therewith; the hook portions 122*a* of the lock levers 122 are engaged with the projections 128 because the hook portions 122*a* elongate at a right angle with respect to the direction along which the frame 120 is to be opened (the direction which is substantially identical with the direction B in the projections 138) and butt against the projections 138 to be engaged therewith; and the engagement between the engaging pawls 135*a* and the projections 147 is canceled because the engagement between the hook portions 122*a* and the projections 138 is held, the front cover 110, the frame 120, and the frame 130 are integrated with one another, and the engaging pawls 135*a* elongate at an obtuse angle with respect to the direction along which the front cover 130 is to be opened (the direction which is substantially identical with the direction B in the projections 147) and butt against the projections 147 to be engaged therewith. As shown in FIG. 6B, therefore, the front cover 110, the frame 120, and the frame 130 are integrally opened, and the opening portion 190 for enabling the process units to be attached and detached is opened.

In Embodiment 1 described above, the frame 140 and the support frame 150 function as the mainframe, the frame 130 functions as the first opening and closing member, the frame 120 functions as the second opening and closing member, the front cover 110 as the third opening and closing member, and the photosensitive drums 14 function as the electrostatic latent image carriers.

The support shafts 121, the lock levers 122, the hook portions 122*a*, the springs 123, the projections 138, and the handle 117 function as the first coupling section and the first canceling section, and the support shafts 111, the lock levers 112, the hook portions 112*a*, the springs 113, the projections 128, and the handle 117 function as the second coupling section and the second canceling section.

The projections 147 function as the first engaged member, the projections 137 as the second engaged member, and the projections 127 as the third engaged member.

The engaging levers 135 function as the first engaging member, the engaging levers 125 as the second engaging member, and the engaging levers 115 as the third engaging member.

The springs 136 function as the first urging section, the springs 126 as the second urging section, and the springs 116 as the third urging section.

The front cover 110 functions as the cover member, and the handle 117 as the operating portion.

The series of operations consisting of the operations on the handle 117 in the directions A and B shown in FIGS. 4A and 4B functions as the third operation, the operation on the handle 117 in the direction B shown in FIG. 5 functions as the fourth operation, and the series of operations consisting of the operations on the handle 117 in the directions C and B shown in FIGS. 6A and 6B functions as the fifth operation.

The intermediate transfer rollers 24 function as the intermediate transferring section, the secondary transfer roller 25 functions as the recording medium transferring section in the invention, and the discharge roller pair 61 and the flapper 62 function as the inverting section.

In the thus configured color laser printer 1, it is possible to open only the front cover 110 with respect to the frame 120, and the front cover 110 and the frame 120 can be integrally opened without opening the frame 130. Furthermore, the front cover 110, the frame 120, and the frame 130 can be integrally opened.

When the sheet P is jammed in the inversion and transport path 64, therefore, the inversion and transport path 64 is opened by opening only the front cover 110, so that the sheet P jammed in the inversion and transport path 64 can be removed away. When the sheet P is jammed in the sheet transport path 71, moreover, the sheet transport path 71 can be opened by integrally opening the frame 120 and the front cover 110. Therefore, the sheet P jammed in the sheet transport path 71 can be easily removed away. When the process units are to be attached or detached, moreover, the opening portion 190 for enabling the process units to be attached or detached can be opened by integrally opening the frame 130, the frame 120, and the front cover 110. Therefore, the opening portion 190 can be easily opened.

After only the front cover 110 is opened, the frame 120 can be opened without opening the frame 130; after the frame 120 is opened, the frame 130 can be opened; and, after only the front cover 110 is opened, the frame 120 and the frame 130 can be integrally opened.

In the case where the sheet transport path 71 is to be opened after the inversion and transport path 64 is opened, it is not required to perform a procedure in which the front cover 110 is once closed and the front cover 110 and the frame 120 are then integrally opened. Consequently, the sheet transport path 71 can be easily opened. In the case where the opening portion 190 is to be opened after the sheet transport path 71 is opened, similarly, it is not required to perform a procedure in which the front cover 110 and the frame 120 are once closed and the front cover 110, the frame 120, and the frame 130 are then integrally opened. Consequently, the opening portion 190 can be easily opened.

In the case where the opening portion 190 is to be opened after the inversion and transport path 64 is opened, similarly, it is not required to perform a procedure in which the front cover 110 is once closed and the front cover 110, the frame 120, and the frame 130 are then integrally opened. Consequently, the opening portion 190 can be easily opened.

By the series of operations consisting of the operations on the handle 117 in the directions A and B shown in FIG. 4, the engagement between the hook portions 112*a* and the projections 128 is canceled, and only the front cover 110 is opened, so that the inversion and transport path 64 can be opened. By the operation on the handle 117 in the direction B shown in FIG. 5, the front cover 110 and the frame 120 are integrally opened while the engagement between the hook portions 112*a* and the projections 128 is maintained, so that the sheet transport path 71 can be opened. By the series of operations consisting of the operations on the handle 117 in the directions C and B shown in FIG. 6, the hook portions 122*a* are engaged with the projections 138, and the front cover 110, the frame 120, and the frame 130 are integrally opened while the engagement between the hook portions 112*a* and the projections 128 is maintained, so that the opening portion 190 can be opened.

In accordance with an operation on the handle 117, therefore, it is possible to select whether only the front cover 110 is opened to open the inversion and transport path 64, the front cover 110 and the frame 120 are integrally opened without opening the frame 130 to open the sheet transport path 71, or the front cover 110, the frame 120, and the frame 130 are integrally opened to open the opening portion 190. Since the place to be opened can be changed by an operation on the single handle 117, the operator can easily operate the printer.

Since the fixing unit 30 is placed in a level higher than the photosensitive drums 14, the photosensitive drums 14 can be prevented from being heated by the heat of the fixing unit 30. Since the photosensitive drums 14, the sheet feeding unit 40, and the sheet discharging tray 50 are placed in a vertically stacked manner, the installation area of the color laser printer 1 can be reduced.

Embodiment 2

Hereinafter, Embodiment 2 of the invention will be described with reference to the accompanying drawings.

Figure 7:
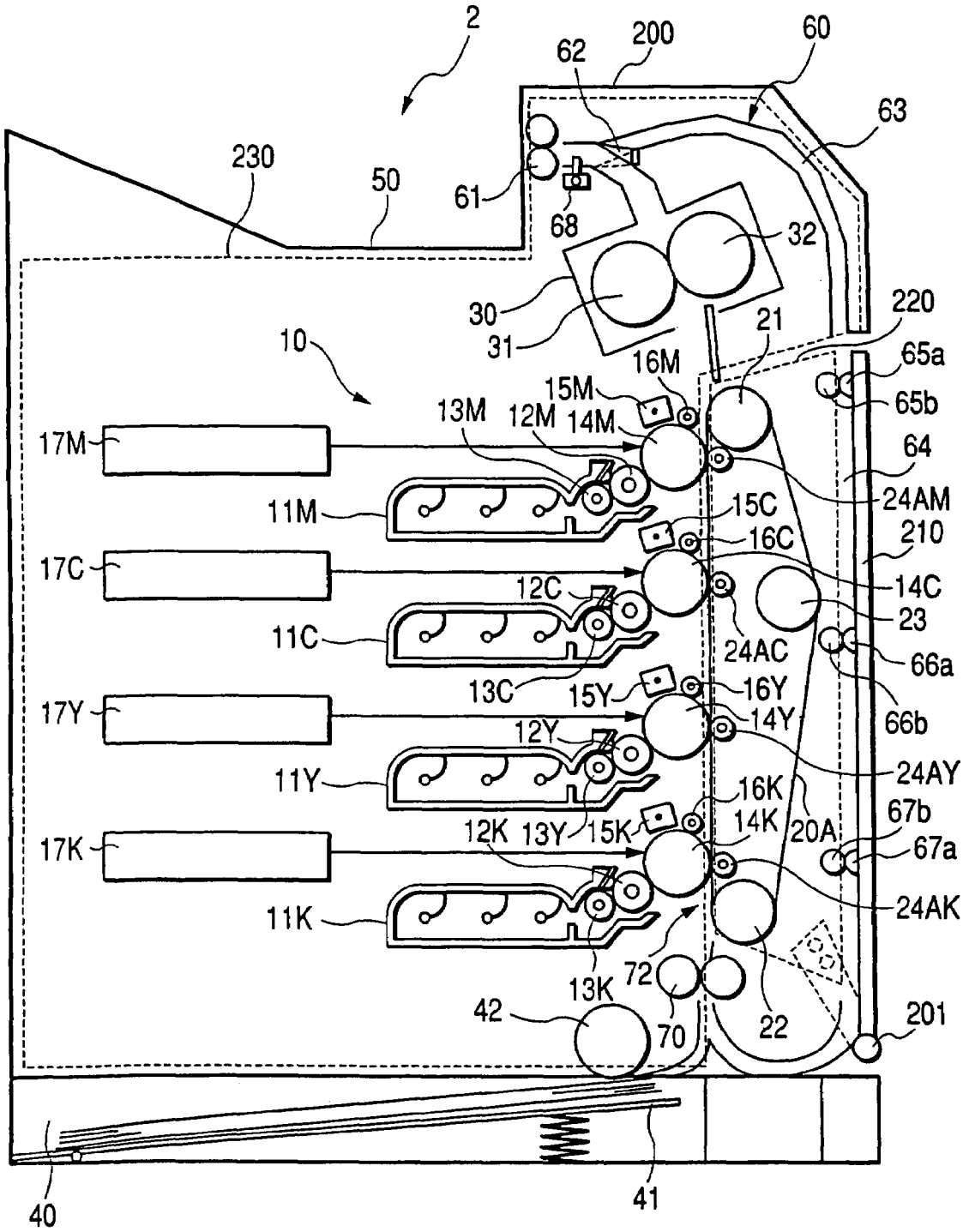
FIG. 7 is a schematic side section view of a color laser printer of Embodiment 2.

FIG. 7 is a schematic side section view of a color laser printer 2 that is an image forming apparatus to which the invention is applied. The color laser printer 2 which is exemplarily shown in FIG. 7 comprises an image forming unit 10, a sheet transport belt 20A, a fixing unit 30, a sheet feeding unit 40, a sheet discharging tray 50, and an inverting and transporting unit 60.

These components other than the sheet transport belt 20A are identical with those of Embodiment 1, and therefore the description of the components other than the sheet transport belt 20A is omitted.

As shown in FIG. 7, the sheet transport belt 20A is looped around one driving roller 21A and two driven rollers 22A, 23A. Transfer rollers 24AM, 24AC, 24AY, 24AK are disposed in the vicinities of positions where the belt is opposed to photosensitive drums 14M, 14C, 14Y, 14K, respectively. As shown in FIG. 7, the surface of the sheet transport belt 20A on the side opposed to the photosensitive drums 14M, 14C, 14Y, 14K is set so as to be moved from the vertically lower side to the upper side.

Next, the operation of the thus configured color laser printer 2 of the embodiment will be described.

First, the surfaces of the photosensitive drums 14M, 14C, 14Y, 14K are uniformly charged by charging devices 15M, 15C, 15Y, 15K, and then exposed by exposing devices 17M, 17C, 17Y, 17K in accordance with magenta, cyan, yellow, and black images, respectively. Magenta, cyan, yellow, and black developing devices 11M, 11C, 11Y, 11K causes magenta, cyan, yellow, and black toners to adhere to electrostatic latent images formed in the surfaces of the photosensitive drums 14M, 14C, 14Y, 14K, thereby developing magenta, cyan, yellow, and black images.

The sheet feeding unit 40 feeds the sheet P in predetermined timing with the image forming step which is conducted by the image forming unit 10. The sheet P fed from the sheet feeding unit 40 is transported by a transport roller pair 70 to pressure contact portions which are formed respectively between the photosensitive drums 14M, 14C, 14Y, 14K on a sheet transport path 72, and portions of the sheet transport belt 20A where the transfer rollers 24AM, 24AC, 24AY, 24AK are placed.

The sheet transport path 72 is a path along which the sheet P fed from the storage tray 41 of the sheet feeding unit 40 is to be sent to the fixing unit 30 through the pressure contact portions. The toner images of the colors are formed with producing a small time difference therebetween in accordance with the movement speed of the sheet transport belt 20A and the positions of the photosensitive drums 14M, 14C, 14Y, 14K, and then transferred so as to overlap with one another on the sheet P on the sheet transport belt 20A.

The transferred toner images are fixed to the sheet P by the fixing unit 30, and the sheet is then discharged onto the sheet discharging tray 50. As a result, a four-color image is formed.

In the case where images are to be formed respectively on both the faces of the sheet P, the printer operates in the following manner. When the sheet P in which an image has been formed on one face is sent to a discharge roller pair 61, the discharge roller pair 61 is forward rotated while clamping the sheet P, to once transport the sheet P toward the outside (the sheet discharging tray 50). Immediately after a major portion of the sheet P is sent to the outside and the rear end of the sheet P is detected by a discharge sensor 68, the forward rotation is stopped, and the transportation direction is switched over by a flapper 62 so that the sheet P can be transported to an inversion and transport path 63.

Then, the discharge roller pair 61 is reversely rotated to transport the sheet P into the inversion and transport path 63. The sheet P which is transported to the inversion and transport path 63 is further transported to the transport roller pair 70 by inverting and transporting roller pairs 65, 66, 67.

The sheet P which is transported to the transport roller pair 70 is in the reversed state, and again transported by the transport roller pair 70 toward the pressure contact portions between the photosensitive drums 14 and the portions of the sheet transport belt 20A where the transfer rollers 24A are placed. Toner images are transferred to the back face, and then fixed thereto. As a result, images are formed respectively on both the faces of the sheet P.

The color laser printer 2 comprises a front cover 210, a first frame 220, and a second frame 230 in a main unit casing 200 (see FIG. 7). An inversion and transport path 64 is formed between the front cover 210 and the frame 220, and the sheet transport path 72 is formed between the frame 220 and the frame 230. When the frame 220 is opened, an opening portion 190 for enabling the process units to be attached or detached, and the sheet transport path 72 are opened.

Driven rollers 65*a*, 66*a*, 67*a* of the inverting and transporting roller pairs are supported by the front cover 210. Driving rollers 65*b*, 66*b*, 67*b* of the inverting and transporting roller pairs, the sheet transport belt 20A, the transfer rollers 24AM, 24AC, 24AY, 24AK, the driving roller 21, and the driven rollers 22 and 23 are supported by the frame 220. The image forming unit 10, the fixing unit 30, and a part of the inverting and transporting unit 60 are supported by the frame 230 (see FIG. 7).

The front cover 210 and the frame 220 are swingable about a rotation shaft 201, so as to be supported openably and closably by the frame 230.

The opening and closing mechanism of the color laser printer 2 of Embodiment 2 of the invention can be easily configured with reference to that of the color laser printer 1 of Embodiment 1. Therefore, the opening and closing mechanism of the color laser printer 2 will be described with reference to, FIG. 3.

In the same arrangement as in the front cover 110, support shafts 111, lock levers 112, springs 113, a handle 117, engaging levers 115, support shafts 114, and springs 116 are disposed on both the side faces of the front cover 210 (see FIG. 3).

In the same arrangement as in the frame 120, a handle 129, projections 127, support shafts 124, engaging levers 125, springs 126, and projections 128 are disposed on both the side faces of the frame 220. In the same arrangement as in the frame 140, projections 147 are disposed, and a support frame 150 is secured (see FIG. 3).

The lock levers 112 are supported on the side faces of the front cover 210 so as to be swingable about the support shafts 111, respectively. At one end, the lock levers 112 have hook portions 112*a* which are engageable and disengageable with the projections 128 disposed on the side faces of the frame 220, and are urged by the springs 113 attached to the front cover 210, in the direction along which the hook portions 112*a* are to be engaged with the projections 128, respectively. The handle 117 is attached to the other ends of the lock levers 112 so as to connect the other ends together.

In a state where the hook portions 112*a* are caused by the springs 113 to be engaged with the projections 128, the tip ends of the hook portions 112*a* are engaged with the projections 128, and, when the handle 117 is operated, the lock levers 112 can be moved in the urging direction of the springs 113.

The engaging levers 115 are supported on the side faces of the front cover 210 so as to be swingable about the support shafts 114, respectively. At one end, the engaging levers 115 have engaging pawls 115*a* which are engageable and disengageable with the projections 127 disposed on the side faces of the frame 220, and are urged by the springs 116 attached to the frame 210, in the direction along which the engaging pawls 115*a* are to be engaged with the projections 127, respectively.

The engaging levers 125 are supported on the side faces of the frame 220 so as to be swingable about the support shafts 124, respectively. At one end, the engaging levers 125 have engaging pawls 125*a* which are engageable and disengageable with the projections 147 disposed on the side faces of the frame 230, and are urged by the springs 126 attached to the frame 220, in the direction along which the engaging pawls 125*a* are to be engaged with the projections 147, respectively.

The urging force of the springs 126 is larger than that of the springs 116.

Next, the operation in the case where only the front cover 210 is to be opened will be described with reference to FIG. 3.

When the front cover 210 and the frame 220 are in the closed state, the hook portions 112*a* of the lock levers 112 are engaged with the projections 128, the engaging pawls 115*a* of the engaging levers 115 are engaged with the projections 127, and the engaging pawls 125*a* of the engaging levers 125 are engaged with the projections 147.

Figure 8A:
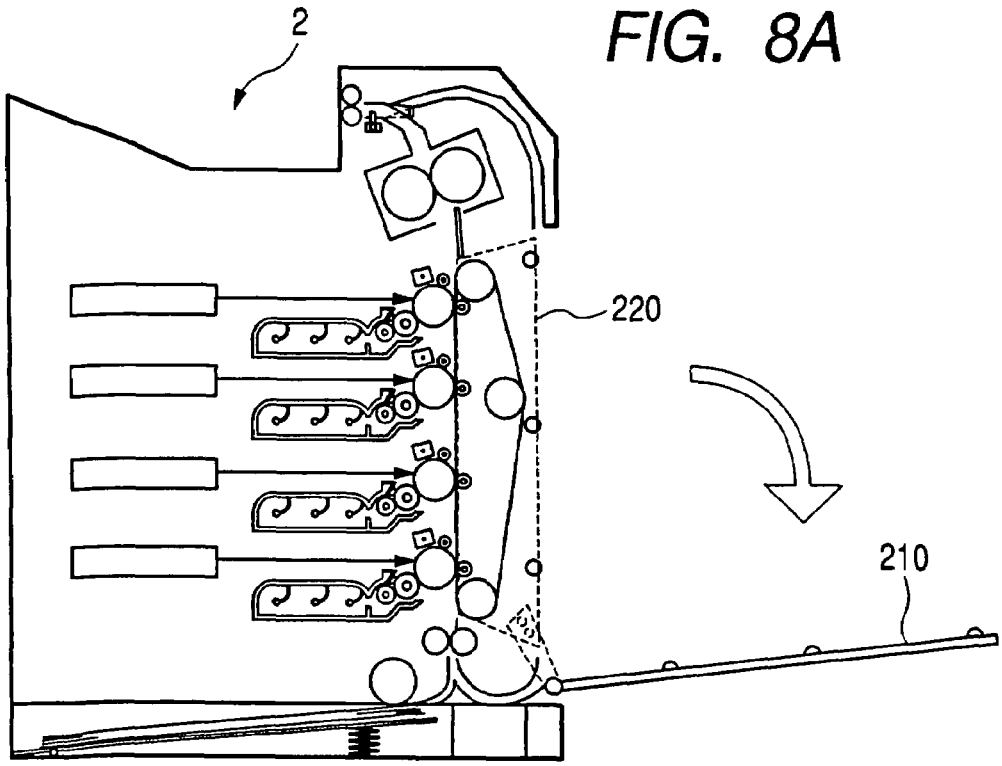
FIGS. 8A and 8B are diagrams of an opened state of the color laser printer of Embodiment 2.

When the handle 117 is swung against the urging force of the springs 113 in a downward direction, the engagement between the hook portions 112*a* and the projections 128 is canceled. When the handle 117 is thereafter pulled in a forward direction (the leftward direction in FIG. 3), the engagement between the engaging pawls 115*a* and the projections 127 is canceled because the urging force of the springs 116 is smaller than that of the springs 126. As shown in FIG. 8A, therefore, only the front cover 210 is opened, and the inversion and transport path 64 is opened.

Figure 8B:
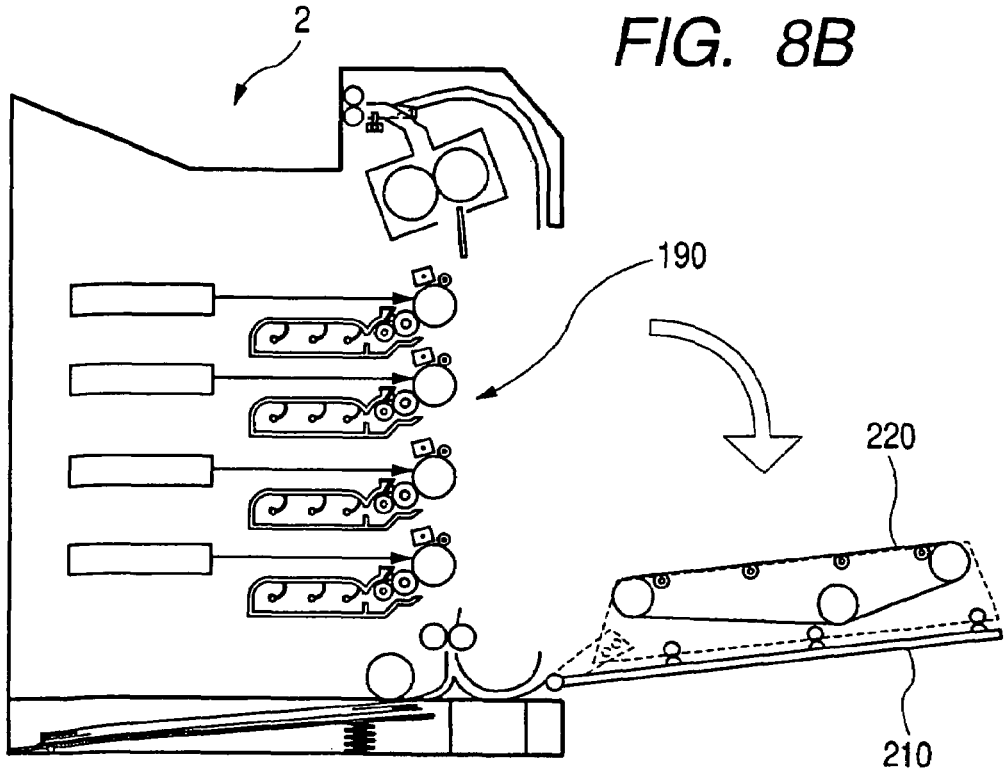

When, in the state where only the front cover 210 is opened, the handle 129 disposed on a side face of the frame 220 is pulled in a forward direction (the leftward direction in FIG. 3), the engagement between the engaging pawls 125*a* and the projections 147 is canceled. As shown in FIG. 8B, therefore, the frame 220 is opened, and the opening portion 190 for enabling the process units to be attached or detached, and the sheet transport path 72 are opened.

Next, an operation in the case where the front cover 210 and the frame 220 are to be integrally opened will be described with reference to FIG. 3.

When, in the state where the front cover 210 and the frame 220 are closed, the handle 117 is pulled in a forward direction (the leftward direction in FIG. 3), the front cover 210 is integrated with the frame 220 because the hook portions 112*a* of the lock levers 112 are engaged with the projections 128, and the engagement between the engaging pawls 125*a* and the projections 147 is canceled. As shown in FIG. 8B, therefore, the front cover 210 and the frame 220 are integrally opened, and the opening portion 190 for enabling the process units to be attached or detached, and the sheet transport path 72 are opened.

In Embodiment 2 described above, the frame 230 and the support frame 150 functions the apparatus main unit, the frame 220 functions as the first opening and closing member, and the front cover 210 to the second opening and closing member.

The transfer rollers 24A function as the recording medium transferring section in the invention, and the discharge roller pair 61 and the flapper 62 function as the inverting section in the invention.

The series of operations consisting of the operations on the handle 117 in the downward and forward directions functions as the first operation in the invention, and the operation on the handle 117 in the forward direction in the case where the front cover 210 and the frame 220 are to be integrally opened functions as the second operation in the invention.

In the thus configured color laser printer 2, it is possible to open only the front cover 210 so as to open the inversion and transport path 64, and the front cover 210 and the frame 220 can be integrally opened so as to open the sheet transport path 72 and the opening portion 190.

When the sheet P is jammed in the inversion and transport path 64, therefore, the inversion and transport path 64 is opened by opening only the front cover 210 without opening the frame 220, so that the sheet P jammed in the inversion and transport path 64 can be removed away. When the sheet P is jammed in the sheet transport path 72 or the process units are to be attached or detached, moreover, the sheet transport path 72 and the opening portion 190 can be opened by integrally opening the frame 220 and the front cover 210. Therefore, the sheet transport path 72 and the opening portion 190 can be easily opened.

In the above, the embodiments of the invention have been described. It is a matter of course that the mode for carrying out the invention is not restricted to the embodiments, and may be variously modified as far as belonging to the technical scope of the invention.

In Embodiment 1 described above, the printer comprises the intermediate transfer member, the sheet transport path, and the inversion and transport path so that printing can be conducted on both faces of a sheet. For example, such a printer may comprise an intermediate transfer member and a sheet transport path so that printing can be conducted only on one face of a sheet. In this case, two opening and closing members are used as in Embodiment 2.

In Embodiment 1, the front cover 110 and the frame 120 can be integrally opened simply by operating the handle 117 in the direction B. Alternatively, the front cover 110, the frame 120, and the frame 130 may be configured so as to be integrally opened by the operation. The combinations of the kind of operation and opening and closing members are not restricted to those described above.

The plural opening and closing members are swingable about the common shaft. Alternatively, the opening and closing members may have respective swing centers.

The front cover 110 may be swingably disposed on the frame 120, the frame 120 may be swingably disposed on the frame 130, and the front cover 110 and the frame 120 may be swingably disposed on the frame 130.

In each of the process units, a photosensitive member and a developing device are integrated with each other. Alternatively, a photosensitive member and a developing device may be formed so as to be separately attached to and detached from the color laser printer 1.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. An image forming apparatus, comprising:

a front cover;

a sheet storage tray that stores sheets;

a first frame;

a second frame, wherein the first frame is movable relative to the second frame;

a belt provided in the second frame;

a third frame, wherein the second frame is movable relative to the third frame;

a plurality of process units arranged in the third frame, the plurality of process units being aligned along the length of and opposite to the belt;

a sheet discharge tray;

a first transport path between the first frame and the second frame that transports a sheet from the storage tray to the sheet discharge tray, the first transport path being between the first frame and the second frame;

a fixing unit being outside of the first transport path; and a second transport path between the front cover and the first frame that transports the sheet from the sheet discharge tray to the first transport path during double-sided printing;

wherein the image forming apparatus is structured to have:

a first state where the front cover, the first frame and the second frame are closed, a second state where the front cover is opened and the first frame and the second frame are closed, a third state where the front cover and the first frame are opened and the second frame is closed, a fourth state where the front cover, the first frame and the second frame are opened.

2. The image forming apparatus according to claim 1:

wherein the front cover includes a retainment mechanism including a hook provided on the front cover and a projection provided on the first frame, the hook being engageable and disengageable with the projection.

3. The image forming apparatus according to claim 1:

wherein the first frame is provided with a plurality of first rollers.

4. The image forming apparatus according to claim 3:

wherein the front cover is provided with at least one second roller, and wherein the at least one roller faces the plurality of first rollers when the front cover is retained to the first frame.

5. The image forming apparatus according to claim 4:

wherein the plurality of first rollers and the at least one second roller transport a recording medium within the second transport path from the sheet discharge tray to the first transport path.

6. The image forming apparatus according to claim 2:

wherein the first frame is configured to be rotationally movable between an opened state and a closed state when the front cover is in the open state, wherein the second frame is configured to be rotationally movable between the open state and the closed state when the first frame is in the open state, and wherein the process units are exposed when the second frame is moved to the opened state.

7. The image forming apparatus according to claim 1:

wherein the process units are exposed in the fourth state.

8. The image forming apparatus according to claim 2:

wherein the third state can be attained by pulling on a handle attached to the retainment mechanism.

9. An image forming apparatus, comprising:
a front cover;
a sheet storage tray that stores sheets;
a first frame;
a second frame, wherein the first frame is movable relative to the second frame;
a belt provided in the second frame;
a third frame, wherein the second frame is movable relative to the third frame;
a plurality of process units arranged in the third frame, the plurality of process units being aligned along the length of and opposite to the belt;
a sheet discharge tray;
a first transport path between the first frame and the second frame that transports a sheet from the storage tray to the sheet discharge tray, the first transport path being between the first frame and the second frame;
a fixing unit being outside of the first transport path; and
a second transport path between the front cover and the first frame that transports the sheet from the sheet discharge tray to the first transport path during double-sided printing;
wherein the image forming apparatus is structured to have:
a first state where the front cover, the first frame and the second frame are closed,
a second state where the front cover is opened and the first frame and the second frame are closed,
a third state where the front cover and the first frame are opened and the second frame is closed, wherein the front cover and the first frame open integrally when movement from the first state to the third state is initiated,
a fourth state where the front cover, the first frame and the second frame are opened.

10. The image forming apparatus according to claim 9:
wherein the front cover includes a retainment mechanism including a hook provided on the front cover and a projection provided on the first frame, the hook being engageable and disengageable with the projection.

11. The image forming apparatus according to claim 9:
wherein the first frame is provided with a plurality of first rollers.

12. The image forming apparatus according to claim 11:
wherein the front cover is provided with at least one second roller, and
wherein the at least one roller faces the plurality of first rollers when the front cover is retained to the first frame.

13. The image forming apparatus according to claim 12:
wherein the plurality of first rollers and the at least one second roller transport a recording medium within the second transport path from the sheet discharge tray to the first transport path.

14. The image forming apparatus according to claim 10:
wherein the first frame is configured to be rotationally movable between an opened state and a closed state when the front cover is in the open state,
wherein the second frame is configured to be rotationally movable between the open state and the closed state when the first frame is in the open state, and
wherein the process units are exposed when the second frame is moved to the opened state.

15. The image forming apparatus according to claim 9:
wherein the process units are exposed in the fourth state.

16. The image forming apparatus according to claim 10:
wherein the third state can be attained by pulling on a handle attached to the retainment mechanism.

17. An image forming apparatus, comprising:
a front cover;
a sheet storage tray that stores sheets;
a first frame;
a second frame, wherein the first frame is movable relative to the second frame;
a belt provided in the second frame;
a third frame, wherein the second frame is movable relative to the third frame;
a plurality of process units arranged in the third frame, the plurality of process units being aligned along the length of and opposite to the belt;
a sheet discharge tray;
a first transport path between the first frame and the second frame that transports a sheet from the storage tray to the sheet discharge tray, the first transport path being between the first frame and the second frame;
a fixing unit being outside of the first transport path; and
a second transport path between the front cover and the first frame that transports the sheet from the sheet discharge tray to the first transport path during double-sided printing;
wherein the image forming apparatus is structured to have:
a first state where the front cover, the first frame and the second frame are closed,
a second state where the front cover is opened and the first frame and the second frame are closed,
a third state where the front cover and the first frame are opened and the second frame is closed,
a fourth state where the front cover, the first frame and the second frame are opened, the front cover, the first frame and the second frame being integrally moveable from the first state to the fourth state is initiated.

18. The image forming apparatus according to claim 17:
wherein the front cover includes a retainment mechanism including a hook provided on the front cover and a projection provided on the first frame, the hook being engageable and disengageable with the projection.

19. The image forming apparatus according to claim 17:
wherein the first frame is provided with a plurality of first rollers.

20. The image forming apparatus according to claim 19:
wherein the front cover is provided with at least one second roller, and
wherein the at least one roller faces the plurality of first rollers when the front cover is retained to the first frame.

21. The image forming apparatus according to claim 20:
wherein the plurality of first rollers and the at least one second roller transport a recording medium within the second transport path from the sheet discharge tray to the first transport path.

22. The image forming apparatus according to claim 18:
wherein the first frame is configured to be rotationally movable between an opened state and a closed state when the front cover is in the open state,
wherein the second frame is configured to be rotationally movable between the open state and the closed state when the first frame is in the open state, and
wherein the process units are exposed when the second frame is moved to the opened state.

23. The image forming apparatus according to claim 17:
wherein the process units are exposed in the fourth state.

24. The image forming apparatus according to claim 18:
wherein the third state can be attained by pulling on a handle attached to the retainment mechanism.

* * * * *